United States Patent [19]

Boling

[11] Patent Number: 4,489,541

[45] Date of Patent: Dec. 25, 1984

[54] YARN PACKAGE AND APPARATUS FOR WINDING COVERED YARN

[75] Inventor: Terry L. Boling, Taylorsville, N.C.

[73] Assignee: Southern Elastic Corporation, Sanford, N.C.

[21] Appl. No.: 505,698

[22] Filed: Jun. 20, 1983

[51] Int. Cl.[3] ..... D01H 13/04; D01H 7/90; D01H 7/04

[52] U.S. Cl. ..... 57/16; 242/118.3

[58] Field of Search ..... 57/3, 6, 16, 17, 18, 57/93, 104, 313, 130, 127, 129, 127.5, 352; 242/118.3, 118.32

[56] References Cited

U.S. PATENT DOCUMENTS

| | | | |
|---|---|---|---|
| 1,958,375 | 5/1934 | Shorrock | 57/16 |
| 2,203,622 | 6/1940 | Voorhis | 57/16 |
| 2,579,244 | 12/1951 | Seifried | 57/16 |
| 3,107,067 | 10/1963 | Atwood et al. | 242/118.32 |
| 3,133,401 | 5/1964 | Servage | 57/18 |
| 3,368,767 | 2/1968 | Schmidt | 242/118.3 X |
| 3,482,390 | 12/1969 | Lesley | 57/16 |
| 4,137,698 | 2/1979 | Tillman | 57/18 |
| 4,164,113 | 8/1979 | Thompson | 57/104 |
| 4,232,507 | 11/1980 | Northup | 57/16 |

*Primary Examiner*—Donald Watkins
*Attorney, Agent, or Firm*—Roy B. Moffitt

[57] ABSTRACT

A yarn package and apparatus for winding covered yarn: (a) the yarn package comprising a cylinder, the surfaces of which vary no more than ±0.001 of an inch and fiber wound on the cylinder; and (b) the apparatus for producing covered yarn comprising a feed means for feeding a supply of elastomeric filament to a pirn assembly; a spindle means; at least one pirn assembly comprising a cylinder, the surfaces of which vary no more than ±0.001 of an inch, and a balloon cap comprising a shank portion and a head portion, the shank portion received in and axially nested inside of one end of the cylinder the head portion having a diameter greater than that of the diameter of the cylinder, the spindle being axially nested inside of the cylinder; a take-up assembly; and a means to rotate the spindle, feed means and take-up assembly.

16 Claims, 11 Drawing Figures

YARN PACKAGE AND APPARATUS FOR WINDING COVERED YARN

BACKGROUND OF THE INVENTION

The disclosed invention concerns itself with the production of covered yarn customarily used in the knitting of a portion or all of women's apparel and men's hosiery, an example of which is shown by element 26 in FIG. 9. The term "covered yarn", wherever used in this specification, is used to describe the combination of elastomeric filament or strand about which there is twisted or wound at least one or more "hard fibers." The term "hard fibers" wherever used in this specification denotes a non-elastic filament or spun yarn; for example, 15 or 20 denier nylon.

Covered yarn is currently manufactured by prior art machines called covering machines, examples of which are manufactured by the Officine Meccaniche Menegattio Company of Monza, Italy and the H. H. Arnold Company of Rockland, Massachusetts. These machines are designed to draw an elastomeric filament from a source, wind or twist about the elastomeric filament at least one hard fiber and then wind the thus produced covered yarn on a core, which can be a paper cone or a cylinder, producing what is called in the textile trade a yarn package. Prior to the advent of the disclosure in U.S. Pat. No. 4,137,698, such yarn packages did not have the desirable feeding or draw-off behavior required by knitting machines. Yarn on such yarn packages had the propensity to "hang up" and "pucker" and thus feed unevenly and undesirably in a knitting operation environment. With the advent of the method and apparatus disclosed in U.S. Pat. No. 4,137,698, the contents of which are incorporated herein by reference as if faithfully reproduced, it was found that by using the method and apparatus disclosed a yarn package could be directly produced without having to rewind the covered yarn of the yarn package to achieve the feeding or the draw-off behavior so vitally desired in knitting machines environment. It has often been said: "One can fool a knitter but not a knitting machine."

Prior art textile covering machines pass the elastomeric strand sought to be covered through the center of a spindle on which a package of yarn (hard fiber) is carried for rotation. Such yarn is subsequently twisted about the elastomeric or center strand using a rotating flyer. A typical prior art machine is one manufactured by the H. H. Arnold Company of Rockland, Massachusetts, Model 55-M. Typically, two vertically spaced apart packages of yarn are utilized on vertically spaced apart spindles and the yarns from these packages are wrapped in opposite directions to completely cover the rubber strand. Spindles are driven by belts at a predetermined r.p.m. See U.S. Pat. No. 4,164,113 for more detail description of the H. H. Arnold Company machine referred to above. One important problem U.S. Pat. No. 4,164,113 recognizes is a desire for increased speeds of rotation of the spindles to increase production. The faster one can rotate the spindle and thereby wind or twist the hard fiber around the elastomeric filament, the greater the production within a given unit of time.

Applicant has found when increased spindle speeds are encountered, using spools or reels of prior art design, there is a limitation of just how fast a covering machine can be operated. Spools, reels or pirns (a cylinder) made from metal (iron, steel and/or aluminum for example) or plastic material (thermoplastic, cross-link, or thermosetting resins) rotated at high speeds, such as aluminum above 25, 000 r.p.m. and steel or plastics above 23,000 to 24,000 r.p.m., vibrate and do not achieve a homogeneous wind. At such speeds, a prior art spindle assembly will heat up.

This invention discloses a solution to this problem. Applicant has discovered that a pirn (a cylinder) can be rotated between 13,000 and 70,000 r.p.m. without any of the previously observed prior art drawbacks; however, the surfaces of the pirn must not vary over ±0.001 of an inch. Furthermore, Applicant has found that the prior art rotating flyer (see element 15 of U.S. Pat. No. 4,164,113) can be eliminated entirely. The apparatus contemplated by this disclosure is a modified Model 55-M, H. H. Arnold Company machine and consists basicaly of (a) a drive pin assembly; (b) a spindle adapted to receive a cylindrical shaped pirn; (c) a cylindrical shaped pirn the surfaces of which do not vary ±0.001 of an inch in which the spindle is axially nested; and, (d) a balloon cap. The balloon cap is a device which in cross-section looks like a nail with a very short shank. It has a cylindrical shank portion integral with a head portion, the shank portion designed so that it can be frictionally engaged and axially nested inside of a terminal portion of the cylinder. The head portion has an overall diameter that is greater than the outside diameter of the cylinder. The opposite end of the cylinder is mechanically received in the receiving means (drive pin assembly), which is essentially the same weight as the balloon cap. Attached to the spindle of the Arnold machine is the drive pin assembly, which imparts rotation to the pirn assembly.

Spindle and pirn speeds up to 70,000 r.p.m. can be achieved; the rotating flyer of prior art machines contemplated by both of the above-identified patents is eliminated; and, a covered yarn package ready to be placed immediately on a knitting machine and having the desired feeding or draw-off behavior can be achieved by this invention. These three improvements over the prior art constitute a device that is not only cheaper (elimination of the rotating flyer) but also increases productivity to extent not heretofore known by the prior art.

SUMMARY OF THE INVENTION

The invention can be summarized as an apparatus for winding covered yarn and a yarn package. The yarn package consists of a cylinder the surfaces of which vary no more than ±0.001 of an inch on which there is wound a hard fiber yarn which is used to make another yarn package of covered yarn comprising an elastomeric filament about which one or more strands of hard fiber are wound. This covered yarn package possesses the desirable feeding and drawoff behaviour so vitally essential for use in the knitting of covered yarn, e.g., it does not have the propensity to "hang up" or "pucker" and thus feeds evenly and desirably in the knitting operation environment.

Apparatus used to produce the above-described covered yarn package contains: (a) a feeding means for feeding a supply of elastomeric filament to at least one pirn assembly; (b) a pirn assembly comprising a cylinder, the surfaces of which cylinder vary no more than ±0.001 of an inch; (c) a balloon cap, which is composed of a head and a shank portion, the shank portion being received and axially nested inside of one end of the cylinder; (d) a take-up assembly; and, (e) a means to rotate the pirn, feed means and takeup assembly. This combination can be operated at speeds between 13,000 and 70,000 r.p.m. without vibration or heat built up to produce a homogeneous wind.

DETAILED DESCRIPTION OF THE INVENTION

Figure 1:
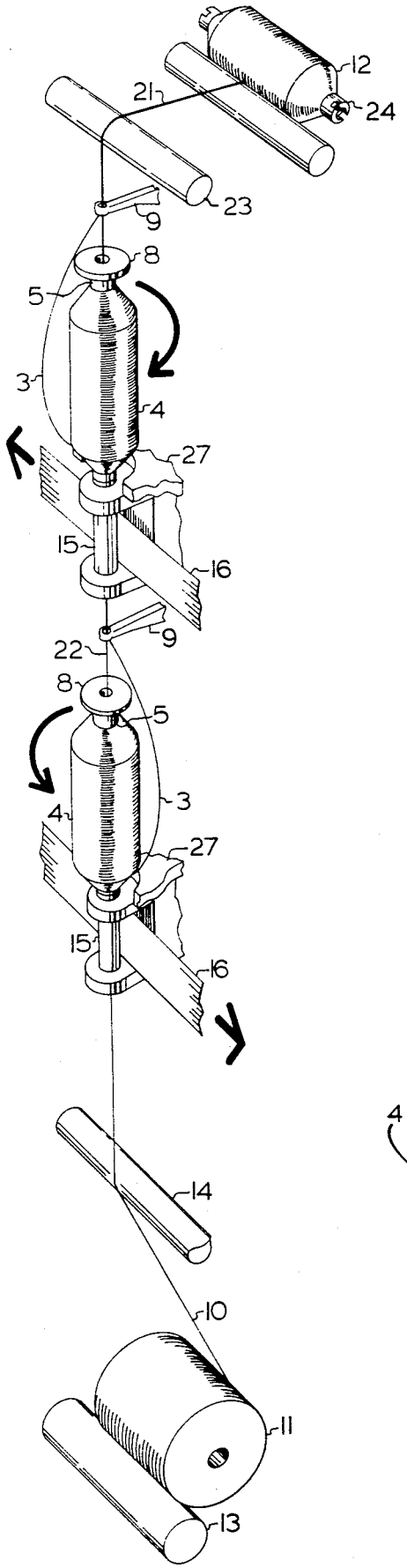
FIG. 1 is a schematic representation of the essential elements of covering machine contemplated by the invention.
Figure 10:
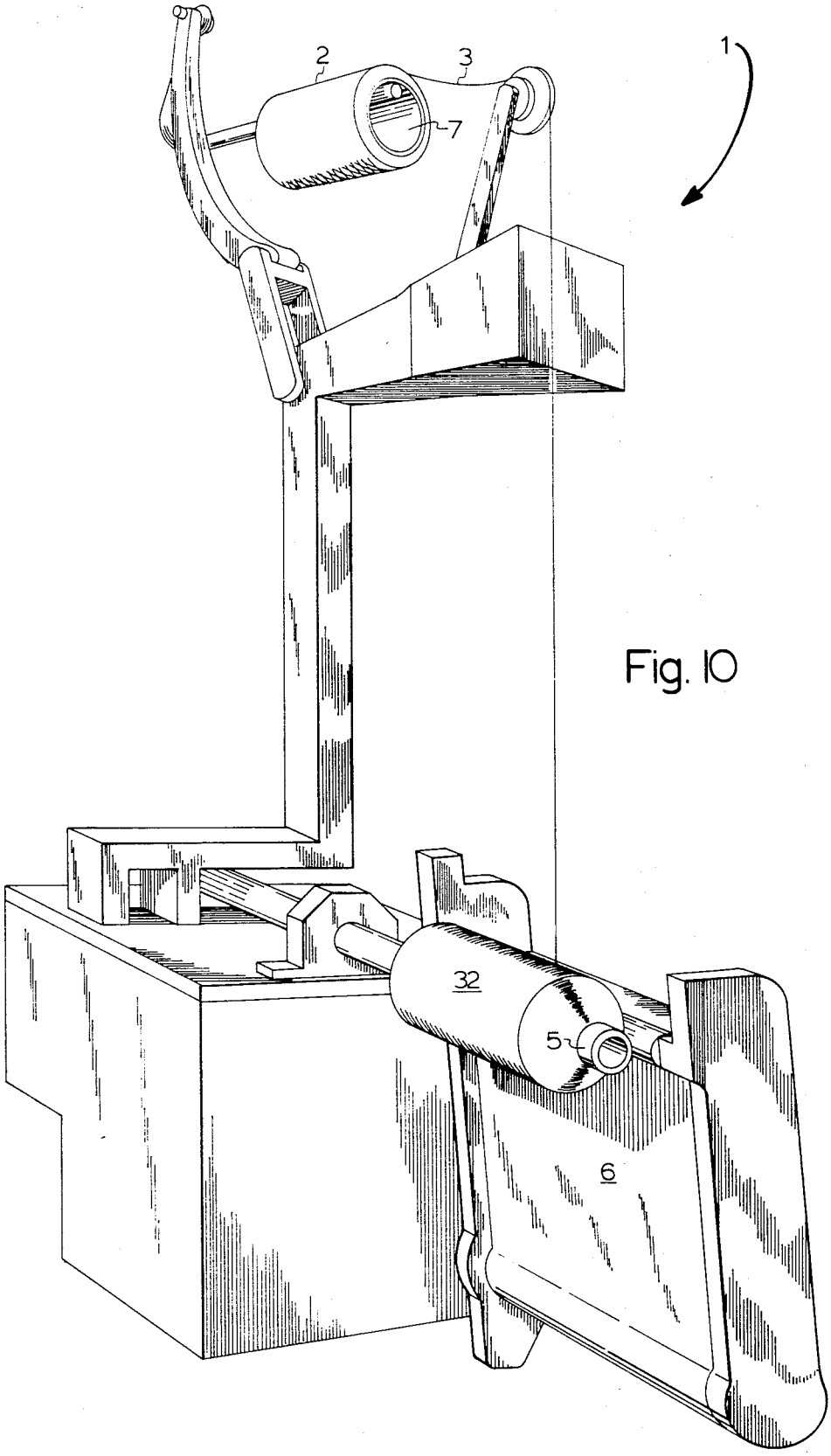
FIG. 10 is a schematic representation of a prior art winding machine used to manufacture the pineapple shaped yarn package 32 containing non-elastic filament or spun yarn used in the apparatus shown in FIG. 1.

FIG. 10 shows a prior art winding machine, more particularly a Conorapid type made by the Alucolor Company used to produce a pineapple shaped yarn package 32 (fiber 3 wound on cylinder 5) ultimately used in the manufacture of covered yarn as shown in FIG. 1. Hard fiber 3, a non-elastic filament or spun yarn wound on tube 7 forming package 2, is drawn from tube 7 and wound on pirn 5 to form a pineapple shaped package 32. This is accomplished by a mandrel (not shown) contained in winding means 6, which is viewed by Applicant to be prior art.

Referring to now FIG. 1, element 11 is a supply package containing elastomeric yarn 10 sought to be covered by hard fiber 3. Element 11 is surface driven at a predetermined number of revolutions per minute by drive roll 13. Elastomeric yarn 10 is passed over guide 14 into a rotatable spindle bottom portion 15, frictionally engaged with belt 16. Belt 16 rotates pirn assembly 4. Element 14 is the lower portion of spindle 29 and is in mechanical engagement with belt 16.

Figure 2:
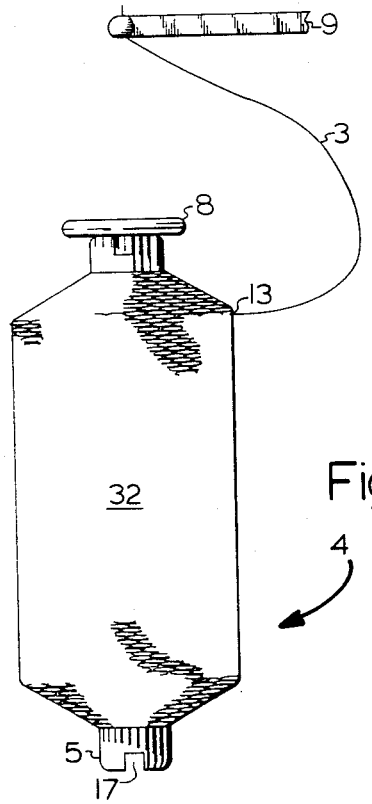
FIGS. 2 and 3 are front elevation of the pirn assembly of FIG. 1 showing the configuration or shape the non-elastic filament or spun yarn takes in its various positions as it is unwound from the pineapple shaped yarn package.
Figure 3:
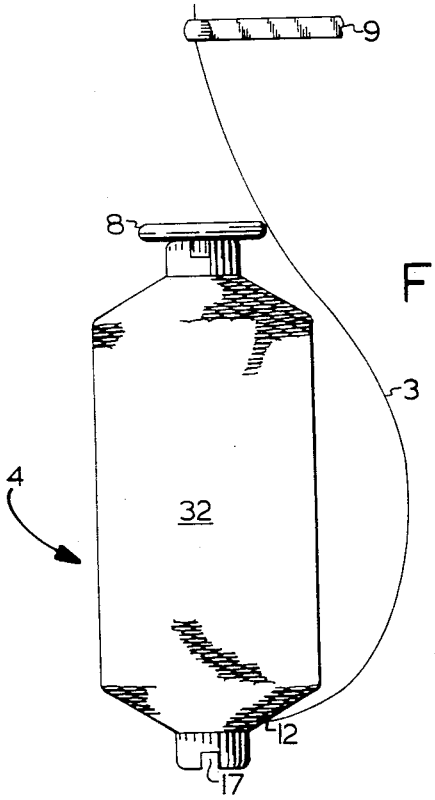

FIGS. 2 and 3 show a pirn assembly 4 consisting of yarn 32, balloon cap 8 and cylinder 5. Cylinder 5 has slots 17 in both terminal portions. Balloon cap 8 is inserted into one end of cylinder 5 and serves to control the spacial path of filament 3 as the pirn assembly 4 is rotated. For purposes of this description the term pirn assembly is used to denote the combination of elements 3, 5 and 8 as well as elements 8 and 32, i.e., the yarn or hard fiber 3 wound thereon. As hard fiber 3 leaves position 13, balloon cap 8 in combination with cylinder 5 controls the fiber 3 spacial configuration in the manner shown in FIG. 2. When the yarn is being removed from position 12, at the opposite end of pirn assembly 4, balloon cap 8 and cylinder 5 combination control the fiber 3 spacial configuration in the manner shown in FIG. 3. Element 9 is a guide means containing a hole therein (not shown), through which covered yarn 22 or 21 passes to the next stage of manufacture.

Figure 11:
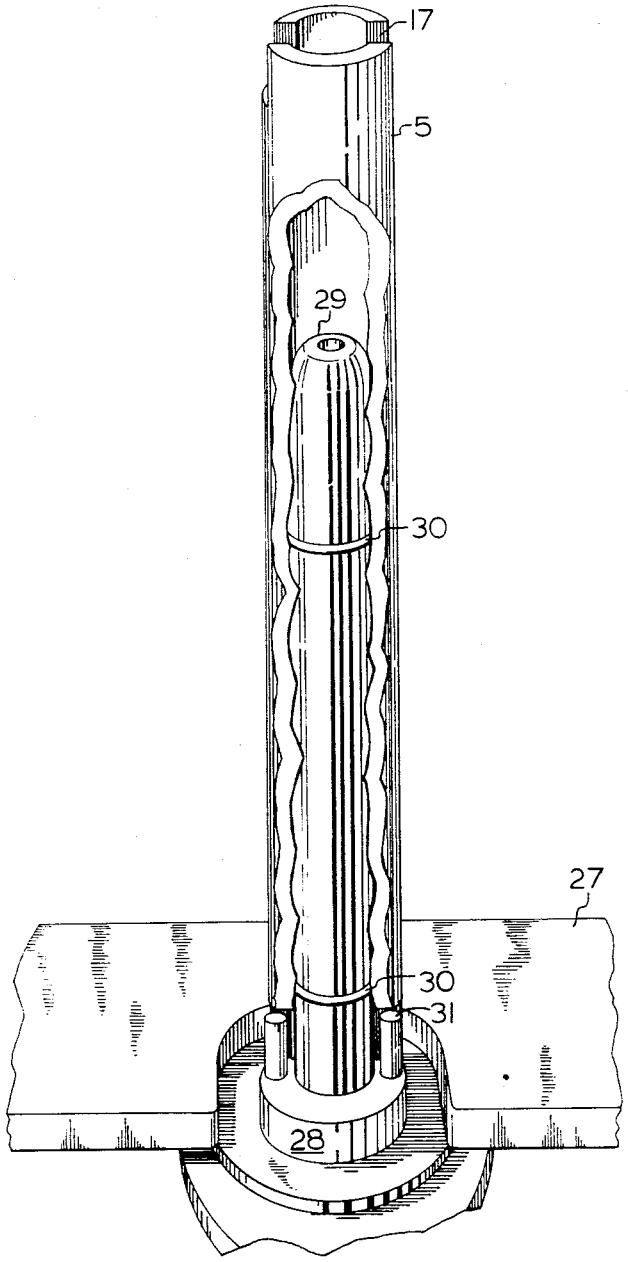
FIG. 11 is a isometric cut-a-way view of a cylinder and drive pin assembly.

Driving element 15, rotatably housed in yoke 27, is connected to a drive pin unit (see element 28 of FIG. 11) in which spindle 29 is axially nested and attached. Cylinder 5 slides over spindle 29 so that the spindle is axially nested inside of cylinder 5. Spindle 29 has a plurality of rubber "O" rings 30 designed to be in frictional engagement with the interior surface of cylinder 5 sidewall. Drive pin unit 28 has two vertically protruding lugs or pins 31 received in slot 17 of cylinder 5 and are used to rotate cylinder 5. While the "O" rings 30 of the spindle 29 may also help in rotating cylinder 5, their main function is cylinder vertical stability, i.e., preventing cylinder 5 from "riding up" the spindle during rotation. The weight of drive pin unit 28 is substantially the same as the weight of balloon cap 8. If balloon cap 8 were to be deleted from the pirn assembly 4 upon rotation, hard fiber 3 would exhibit what is called "sluffage," i.e., an entire layer of hard fiber of yarn 3 would come off pirn assembly 4 at once, rather than one revolution at a time as desired and shown in FIGS. 2 and 3.

Figure 6:
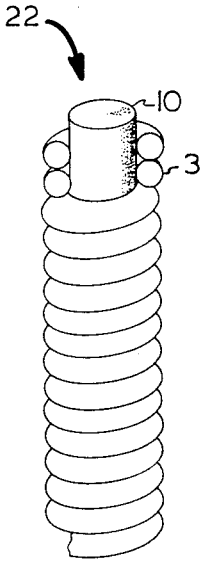
FIG. 6 is a schematic view of covered yarn in the relaxed mode showing a single coverage of hard fiber wound around a core of elastomeric filament.
Figure 7:
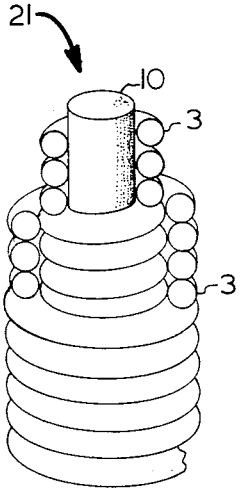
FIG. 7 is a schematic view of a covered yarn in the relaxed mode showing double coverage of hard fibers wound around an elastomeric filament core.

FIG. 1 shows two pirn assemblies 4, one adapted to be rotated in a clockwise and the other adapted to be rotated in a counter clockwise direction. Both pirn assemblies have the same structural elements, the only difference being their direction of rotation. If two pirn assemblies 4 are used, as shown in FIG. 1, a double covered yarn such as that shown by element 21 in FIG. 7 will be achieved. Elastomeric element 10 is covered by a double layer of hard fibers 3, one being wrapped in the clockwise and the other in the counter clockwise direction. If only one pirn assembly 4 is used, a single wrapped or covered fiber will be produced as shown by element 22 in FIG. 6. Here element 22 is a elastomeric filament 10 single covered by hard fiber 3. Whether this is done in a clockwise or counter clockwise direction is immaterial.

Figure 5:
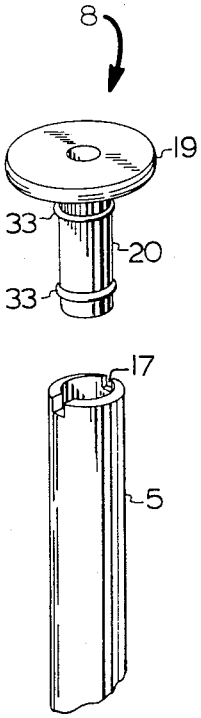
FIG. 5 is an isometric view of the component parts (unassembled) of a pirn assembly 4, namely a cylinder 5 and balloon cap 8.

FIG. 5 shows an exploded representation of how pirn 5 and balloon cap 8 are assembled and constructed. Pirn 5 is a cylinder with slots 17 preferably on both terminal portions of cylinder 5. Cylinder 5 can be made of most any material, aluminum, steel, iron, thermoplastic, thermosetting, or cross-linked resins. The essential feature, however, of pirn 5 is that its surfaces are ground or otherwise molded so that they do not fluctuate more than +0.001 of an inch. Pirn 5 obviously has two surfaces, an inside and outside surface and the requirement previously stated applied both to the inside as well as the outside surface. Balloon cap 8 is composed of two elements, a head 19 and a shank 20. Shank 20 is of a size that can be inserted into the inside of cylinder 5 so that it can be axially nested and frictionally engaged with the sidewall of pirn 5. It may contain "O" rings 33 to aid in this frictional engagement, which controls the vertical position of balloon cap 8 during rotation. Head 19 of balloon cap 8 has a diameter that is greater than the outside diameter of cylinder 5.

Figure 4:
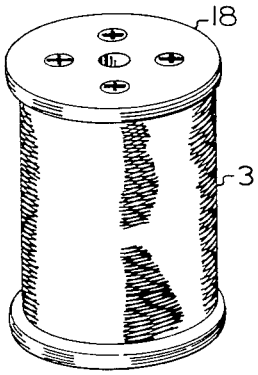
FIG. 4 is an isometric view of a prior art spool upon which non-elastic yarn is wound.

FIG. 4 shows a spool 18 on which there is wound fiber 3 as known in the prior art. Prior arts spools such like 18 made of either plastic or metal can only be rotated up to the neighborhood of 25,000 r.p.m. It has been observed that aluminum spools of this nature could only be operated at 25,000 r.p.m. whereas the maximum r.p.m. of steel or iron spools were in the neighborhood of 23,000 to 24,000. Such is in contrast to the pirn assembly 4 which can be operated between 13,000 and 70,000 r.p.m. In addition, it will be noted that there are no rotating flyers (see element 15 of U.S. Pat. No. 4,164,113 and element 21 of U.S. Pat. No. 4,137,698) necessary in the combination of elements as shown in FIG. 1. The use of the balloon cap 8 in combination with cylinder 5 renders the rotating flyers unnecessary.

Assuming a double covered yarn 21 is desired, the combination of two pirn assemblies as shown in FIG. 1 is used and operated in the manner as described. Finished product 21 will pass over guide bar 23 and then is wound in as a pineapple shaped package 12. Element 12 and element 4 have the same overall pineapple configuration. However, it is not necessary that the cylinder 24 upon which covered fiber 21 is wound to form package 12 to be the same type of cylinder as 5. Here the surface of cylinder 24 is not critical like that as surface of cylinder 5.

It has been found that spools or reels like that shown in element 18 of FIG. 4, even if all surfaces were ground or otherwise prepared so that there would be no variation in such surfaces to the extent of ±0.001 of an inch, rotation above 24,000 r.p.m. resulted in oscillation and wobbling plus eccentric vibration. However, a cylinder like that of cylinder 5 made of iron, aluminum, plastic with all of its surfaces prepared as disclosed, when rotated between 24,000 r.p.m. up to 70,000 r.p.m. there was no oscillation, wobbling or eccentric vibration. It has also found that by using cylinder 5 in combination with balloon cap 8 that the quality of covered yarn 21 or 22 is higher than with prior art machines, i.e., the number of turns of hard fiber 3 about elastomeric filament 10 is far more precise (and easier to control) than that experienced in prior art apparatus.

Figure 8:
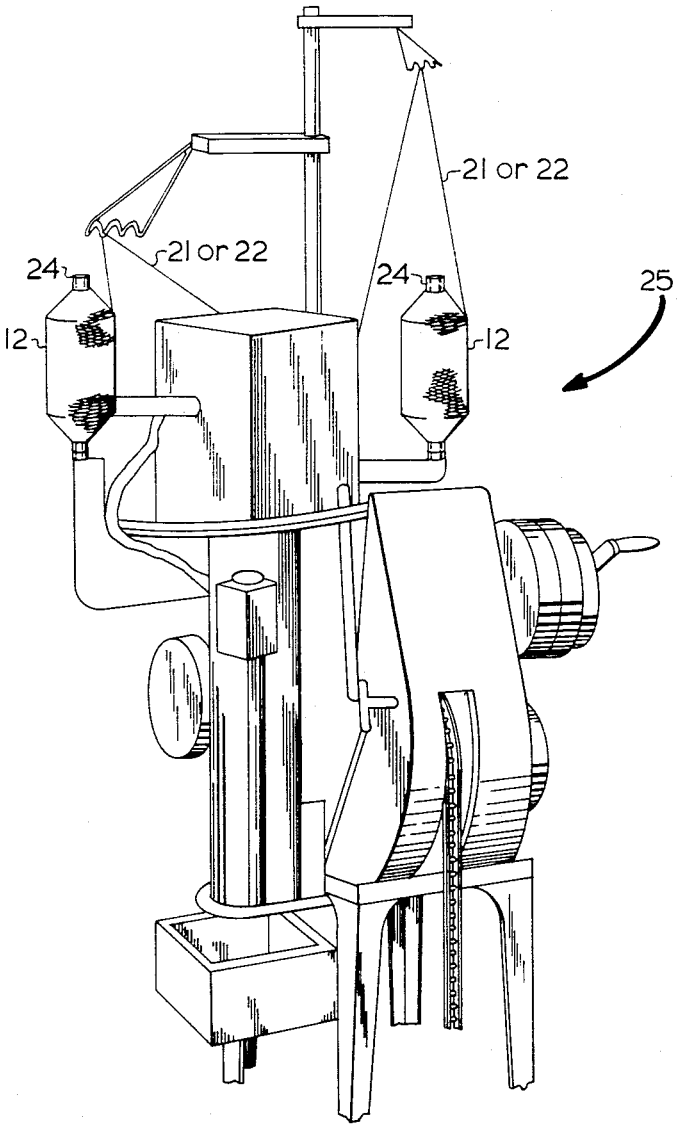
FIG. 8 is a simplified schematic representation of a knitting machine of the type used in knitting of covered yarn.
Figure 9:
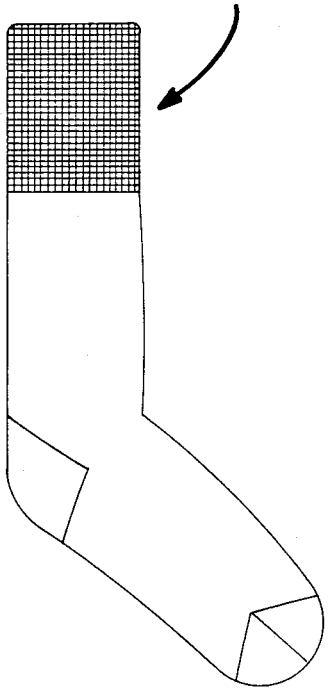
FIG. 9 is a plan view of a typical men's knitted sock containing covered yarn in its uppermost portion.

Yarn package 12, wound in either single wound or single covered fashion is transposed to a knitting machine like that generally shown by element 25 in FIG. 8. Yarn 21 or 22 is then fed in a conventional matter into the knitting machine to knit socks or other garments.

It is well known in the knitting art that human examination of a package of covered yarn is insufficient to determine if the yarn on the package would feed properly into a knitting machine such as that shown by element 25 of FIG. 8. Experienced knitters can be easily fooled. On the other hand, covered yarn from the package cannot fool the knitting machine. Bad courses will result if there is a slightest puckering or hanging as the yarn feeds into the machine. If a particular yarn package will "run," that is to say it has adequate drawing properties, only a knitting machine can tell. Yarn packages 12 made using the disclosed apparatus have been made, knitting machine tested, and found to have superior draw-off properties when compared with the properties of the prior art packages referred to in U.S. Pat. No. 4,137,698. When this desirable feature is taken into account and achieved at speed not disclosed by the prior art (75,000 r.p.m. vs. 25,000 r.p.m.) a desirable step forward has obviously been reached.

What is claimed is:

1. An apparatus for producing a covered yarn composed of at least one strand of hard fiber wound around an elastomeric filament comprising:

(a) a feed means for feeding a supply of elastomeric filament to a pirn assembly;

(b) a spindle means;

(c) at least one prin assembly comprising a cylinder the inside and outside diameters of which vary no more than ±0.001 of an inch and a balloon cap comprising a shank portion and a head portion, said shank portion received and axially nested inside of one end of said cylinder, the head portion having a diameter greater than that of the outside diameter of said cylinder, said spindle axially nested inside of said cylinder;

(d) a take-up assembly; and, (e) a means to rotate said spindle, feed means and take-up assembly.

2. The apparatus of claim 1 containing a drive pin means for said cylinder, said drive pin means having a weight substantially equal to said balloon cap.

3. The apparatus of claim 2 wherein said cylinder has a slot in at least one terminal portion of said cylinder, said slot adapted to be engaged with said drive pin means.

4. The apparatus of claims 1, 2 or 3 containing another pirn assembly.

5. The apparatus of claim 4 wherein said means for rotating said pirn means is adapted to rotate one in a direction opposite from the other.

6. The apparatus of claim 1 containing a yarn quide means disposed in axial alignment with the pirn and balloon cap.

7. The apparatus of claim 1 wherein said cylinder is comprised of a metal, thermoplastic, thermosetting or cross-linked resins.

8. The apparatus of claim 1 wherein said cylinder is composed of phenolic resin.

9. The apparatus of claim 3 wherein said drive pin means contains upstanding lugs received in the slots of said cylinder.

10. The apparatus of claim 1 wherein said spindle contains at least one "O" ring adapted to engage to the sidewall of said cylinder.

11. The apparatus of claim 1 wherein the shank portion of said balloon cap contains at least one "O" ring to engage the sidewall of said cylinder.

12. The apparatus of claim 1 wherein said spindle is composed of two portions, a part of the portion not axially received and nested inside of said cylinder being engaged with the means to rotate said spindle.

13. A yarn package comprising:

(a) a cylinder, the inside and outside diameters of which vary no more than ±0.001 of an inch;

(b) fiber wound on said cylinder;

(c) a balloon cap comprising a shank and head portion, the head portion having a diameter greater than the outside diameter of the cylinder and the shank is axially nested inside of said cylinder.

14. The yarn pacakge of claim 13 wherein said balloon cap shank portion contains an "O" ring adapted to engage the sidewall of said cylinder.

15. The yarn package of claim 13 wherein said cylinder is composed of metal, thermoplastic, thermosetting or cross-linked resins.

16. The yarn package of claim 13 wherein said cylinder is composed of phenolic resin.

* * * * *